US008915072B2

(12) United States Patent
Ko et al.

(10) Patent No.: US 8,915,072 B2
(45) Date of Patent: Dec. 23, 2014

(54) EXHAUST PORT STRUCTURE OF CYLINDER HEAD

(75) Inventors: Seung Woo Ko, Seongnam-si (KR); Hyunwook Ryu, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 119 days.

(21) Appl. No.: 13/534,897

(22) Filed: Jun. 27, 2012

(65) Prior Publication Data

US 2013/0086891 A1 Apr. 11, 2013

(30) Foreign Application Priority Data

Oct. 7, 2011 (KR) ..... 10-2011-0102580

(51) Int. Cl.
*F01N 13/10* (2010.01)
*F02F 1/42* (2006.01)
*F02M 25/07* (2006.01)

(52) U.S. Cl.
CPC . *F01N 13/10* (2013.01); *F02F 1/42* (2013.01); *F02M 25/07* (2013.01)
USPC ..... 60/323; 60/278; 60/280; 60/324

(58) Field of Classification Search
CPC ..... F02M 25/0747; F02M 25/0707; F01N 13/10; F01N 2470/20; F01N 2260/20; F01N 2470/10; Y02T 10/144
USPC ..... 60/278, 280, 323, 324
See application file for complete search history.

(56) References Cited

U.S. PATENT DOCUMENTS

| | | | | |
|---|---|---|---|---|
| 3,644,098 | A * | 2/1972 | De Palma et al. | 422/176 |
| 3,888,081 | A * | 6/1975 | Fitts | 60/321 |
| 5,404,721 | A * | 4/1995 | Hartsock | 60/300 |
| 5,784,882 | A * | 7/1998 | Bonny et al. | 60/323 |
| 5,806,308 | A * | 9/1998 | Khair et al. | 60/278 |
| 6,397,587 | B1 * | 6/2002 | van Nieuwstadt et al. | 60/297 |
| 7,665,297 | B2 * | 2/2010 | Suzuki et al. | 60/287 |
| 8,069,663 | B2 * | 12/2011 | Ulrey et al. | 60/605.2 |
| 2010/0319318 | A1 * | 12/2010 | Miyoshi et al. | 60/277 |
| 2011/0131963 | A1 * | 6/2011 | Reinhart et al. | 60/321 |

FOREIGN PATENT DOCUMENTS

| | | |
|---|---|---|
| JP | 2006-183584 (A) | 7/2006 |
| JP | 2008-095534 (A) | 4/2008 |
| KR | 1998-062598 (A) | 10/1998 |

* cited by examiner

*Primary Examiner* — Thomas Denion
*Assistant Examiner* — Jorge Leon, Jr.
(74) *Attorney, Agent, or Firm* — Morgan, Lewis & Bockius LLP

(57) ABSTRACT

An exhaust port structure of a cylinder head includes a connection pipe communicating with a plurality of exhaust ports of the cylinder head and an exhaust hole connected to the connection pipe and performing a function of an exhaust manifold, wherein the connection pipe has an EGR line integrally formed and connected thereto and each of the exhaust ports is formed with the same shape or a symmetrical shape, and the present invention can reduce the weight of the cylinder head and the manufacturing cost and improve the EGR rate and T/C efficiency.

6 Claims, 5 Drawing Sheets

EXHAUST PORT STRUCTURE OF CYLINDER HEAD

CROSS-REFERENCE TO RELATED APPLICATION

The present application claims priority of Korean Patent Application Number 10-2011-0102580 filed Oct. 7, 2011, the entire contents of which application is incorporated herein for all purposes by this reference.

BACKGROUND OF INVENTION

1. Field of Invention

The present invention relates to an exhaust port structure of a cylinder head. More particularly, the present invention relates to an exhaust port structure of a cylinder head in which an exhaust manifold is integrally formed to the cylinder head so as to reduce weight and improve efficiency.

2. Description of Related Art

In the case of a diesel engine, an exhaust system may include a cylinder head having a plurality of exhaust ports, an exhaust manifold, and a turbocharger.

In most cases, the exhaust manifold is made from expensive materials such as steel use stainless SUS, and the weight of the exhaust manifold is over 3 kg. Therefore, an exhaust manifold integrated cylinder head in which the exhaust manifold is integrally formed with the exhaust ports is provided so as to reduce the weight of the cylinder head and improve durability.

FIG. 1 is a schematic drawing of a conventional art in which the exhaust manifold is integrally formed with the exhaust ports. As shown in FIG. 1, the conventional art has a problem in that there is a large deviation in the flow coefficients Cf of the exhaust ports because the shape of the exhaust ports 1 and 4 connected to the first cylinder C1 and the fourth cylinder C4 is different from the shape of the exhaust ports 2 and 3 connected to the second cylinder C2 and the third cylinder C3. The flow coefficient Cf is defined as a ratio of a quantity of exhaust gas flowing from a combustion chamber after combustion to a quantity of exhaust gas flowing from the end of an exhaust pipe. A smaller deviation of the exhaust flow coefficient of Cf is better for the exhaust gas recirculation rate (EGR rate) and the turbocharger efficiency (T/C efficiency). However, the deviation is large in the case of the conventional art because the flowing routes of the exhaust ports are different from each other because of the shape and length difference of the exhaust ports, such that the prior art has a problem of deteriorating the exhaust gas recirculation rate (EGR rate) and the turbocharger efficiency (T/C efficiency).

Further, the conventional art has a problem that the probability of a head crack increases significantly when the heat load is increased because of the exhaust gas, since the outlets of the exhaust ports 1, 2, 3, and 4 are so close to each other to make up a bulkhead structure S as shown in FIG. 1.

The structure of the conventional art shown in FIG. 1 is also difficult to apply to a diesel engine which is provided with a turbocharger because an exhaust hole 5 is located between the second cylinder C2 and the third cylinder C3.

In the case of the diesel engine provided with a turbocharger, the turbocharger can be located between the third cylinder C3 and the fourth cylinder C4 because it is more profitable for the diesel engine considering lay-out of the diesel engine and load capacity of the vehicle. But in the case of the conventional art, the exhaust hole 5 is located between the second cylinder C2 and the third cylinder C3 as shown in FIG. 1 such that it is structurally difficult to connect the turbocharger with the exhaust hole 5.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for an exhaust port structure of a cylinder head having advantages of reducing weight, improving the EGR rate and the T/C efficiency, and decreasing the probability of a head crack.

Various aspects of the present invention provide for an exhaust port structure of a cylinder head that may include a connection pipe communicating with a plurality of exhaust ports of the cylinder head and an exhaust hole connected to the connection pipe and performing a function of an exhaust manifold, wherein the connection pipe has an EGR line integrally formed and connected thereto, and each of the exhaust ports is formed with the same shape or a symmetrical shape.

The exhaust hole may be formed at a position corresponding to an inlet of a turbocharger.

The EGR line may be extended from a side surface of the connection pipe where the exhaust hole is formed.

Outlets of the exhaust ports are located apart from each other by a predetermined distance.

The connection pipe may be a cuboid pipe having a predetermined width and height.

The exhaust port structure may be applied to a diesel engine.

The exhaust ports of the cylinder head may be integrally formed with the exhaust manifold and further integrally formed with an EGR line such that the weight of the cylinder head can be reduced by deleting an extra pipe for the EGR line.

Various aspects of the present invention provide for improving the EGR rate and the T/C efficiency since each of the exhaust ports is formed with the same shape or a symmetrical shape with reference to the exhaust hole. Various aspects of the present invention provide for an effect that can prevent occurrence of a head crack by disposing each of the exhaust ports apart from each other by a predetermined distance.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

As shown in FIG. 2 to FIG. 5, the exhaust port structure of a cylinder head according to various embodiments of the present invention is integrally provided with a connection pipe 20 which communicates with a plurality of exhaust ports 11, 12, 13, and 14 of the cylinder so as to perform a function of an exhaust manifold, and the connection pipe 20 has an EGR line 30 integrally and/or monolithically formed and connected thereto. In the present invention, the exhaust ports 11, 12, 13, and 14 of the cylinder head are integrally and/or monolithically formed with the exhaust manifold and the EGR line 30 such that the weight of the cylinder head can be reduced by eliminating an extra pipe for the EGR line 30.

It is represented by actual experiments and analysis of applying the present invention to a diesel engine of a car that the weight of the car can be reduced by about 1.74 kg and the cost can be reduced by over 47,000 Won by omitting the exhaust manifold and reducing manufacturing processes for the cylinder head.

Figure 2:
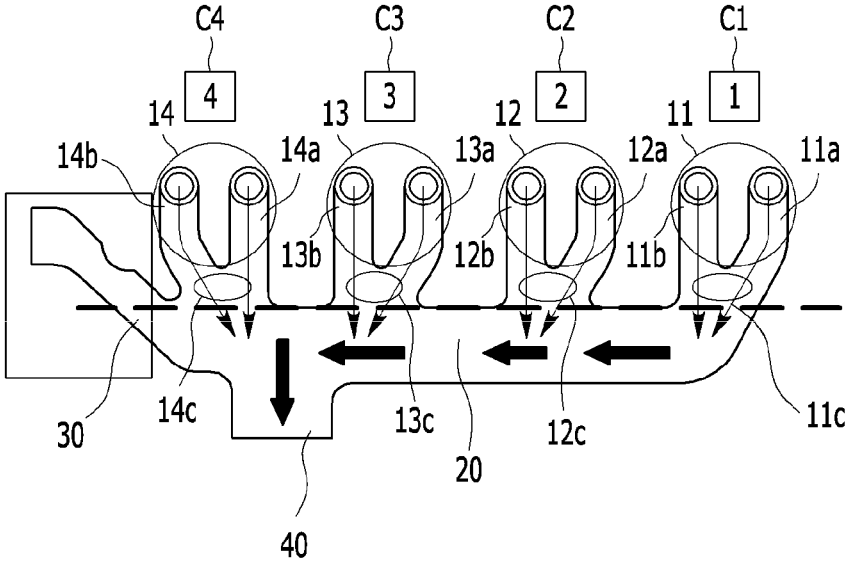
FIG. 2 is a drawing of an exhaust port structure of an exemplary cylinder head according to the present invention.

Each of the exhaust ports 11, 12, 13, and 14 is divided into two ports 11*a* and 11*b*, 12*a* and 12*b*, 13*a* and 13*b*, and 14*a* and 14*b*, and the two divided ports 11*a* and 11 *b*, 12*a* and 12*b*, 13*a* and 13*b*, and 14*a* and 14*b* are combined into one outlet 11*c*, 12*c*, 13*c*, and 14*c* at the region where the connection pipe 20 communicates with the exhaust ports 11, 12, 13, and 14. The exhaust ports 11, 12, 13, and 14 are gradually curved around to an exhaust hole 40. For this, as shown in FIG. 2, one port 11*b*, 12*b*, 13*b*, and 14*a* of the two divided ports may be formed as a straight passage, while the other port 11*a*, 12*a*, 13*a*, and 14*b* may be formed as a curved passage which is curved around to the exhaust hole 40.

Each of the exhaust ports 11, 12, 13, and 14 may be formed with the same shape or a symmetrical shape. As shown in FIG. 2, each of the exhaust ports 11, 12, and 13 which communicate with the first, second, and third cylinders C1, C2, and C3 may be formed with the same shape, and the exhaust port 14 which communicates with the fourth cylinder C4 may be formed with a shape that is symmetrical to the shape of the exhaust ports 11, 12, and 13. The exhaust port 14 communicating with the fourth cylinder C4 is bent in the opposite direction in comparison with the exhaust ports 11, 12, and 13 communicating with the first, second, and third cylinders C1, C2, and C3 because the exhaust hole 40 is located between the third cylinder C3 and the fourth cylinder C4.

The above-mentioned same shape or symmetrical shape of the exhaust ports 11, 12, 13, and 14 has an effect of lowering the deviation of the flow coefficient.

The reason for forming the exhaust ports 11, 12, 13, and 14 with the same shape or a symmetrical shape is to improve the exhaust gas recirculation rate (EGR rate) and turbocharger efficiency (T/C efficiency). The actual flow paths through the exhaust ports 11, 12, 13, and 14 become the same by making the exhaust port 14 which is in the opposite direction to the exhaust ports 11, 12, and 13 with reference to the exhaust hole 40 symmetrical in comparison with the shape of the exhaust ports 11, 12, and 13. Therefore the deviation of the flow coefficient (Cf) of each of the exhaust ports 11, 12, 13, and 14 becomes smaller.

As aforementioned, the flow coefficient Cf is defined as a ratio of a quantity of exhaust gas flowing from a combustion chamber after combustion to a quantity of exhaust gas flowing from the end of an exhaust hole 40. A smaller deviation of the exhaust flow coefficient (CO is better for the EGR rate and T/C efficiency, and a larger the flow coefficient (CO is better for an aspect of back pressure.

Each outlet of the exhaust ports 11*c*, 12*c*, 13*c*, and 14*c* is located at the connection pipe 20 apart from each other by a predetermined distance. In various embodiments, as shown in FIG. 2, each outlet of the exhaust ports 11*c*, 12*c*, 13*c*, and 14*c* may be located apart from each other by a size of the outlet for preventing the bulkhead structure.

Figure 1:
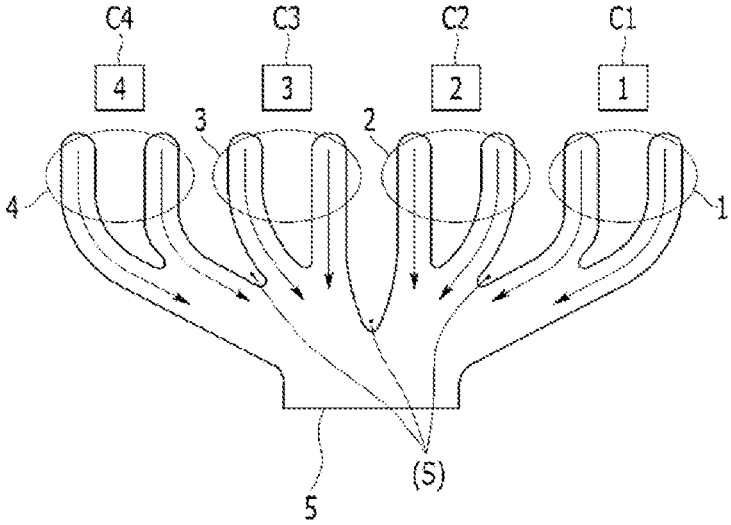
FIG. 1 (Prior Art)
FIG. 1 is a drawing of an exhaust port structure of a cylinder head according to the conventional art.

In comparison with the conventional art shown in FIG. 1, the conventional art has a problem of increasing head cracks because the outlets of the exhaust ports 1, 2, 3, and 4 are so close to make up a bulkhead structure S between the cylinders C1, C2, C3, and C4 such that the probability of head crack increases when the heat load is increased by exhaust gas. But the present invention, as shown in FIG. 2, has a structure that does not make up a bulkhead structure between the cylinders C1, C2, C3, and C4 and can disperse a heat load of exhaust gas by arranging each outlet of the exhaust ports 1, 2, 3, and 4 apart from each other by a predetermined distance. Therefore the present invention can significantly lower the probability of head cracks in comparison with the conventional art.

Figure 3:
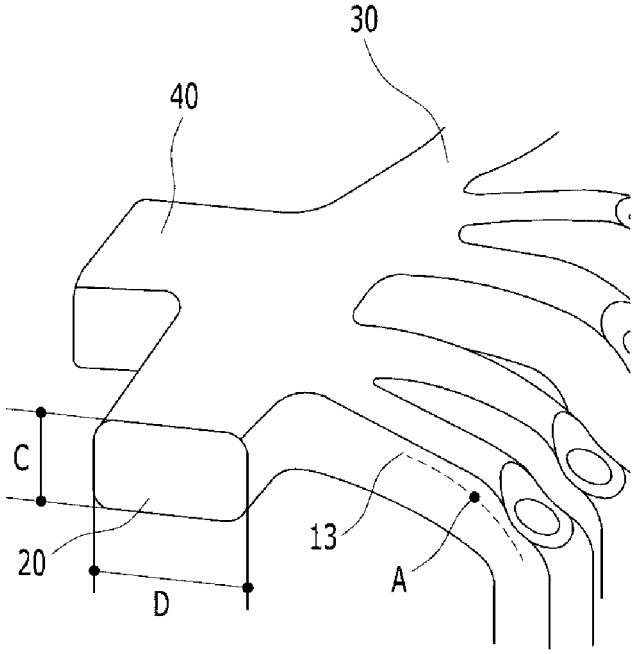
FIG. 3 is a perspective view of an exhaust port structure of an exemplary cylinder head according to the present invention.
Figure 4:
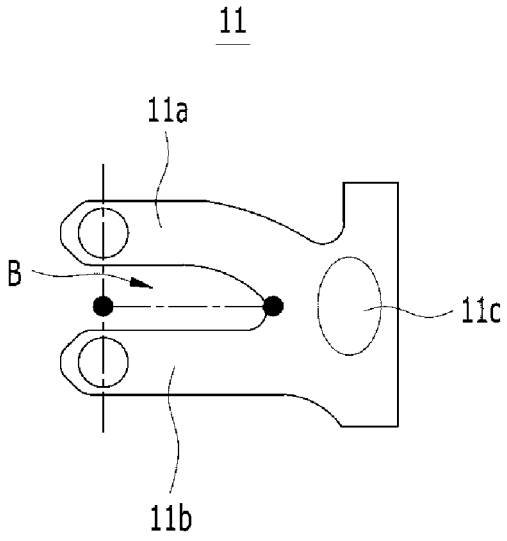
FIG. 4 is a cross-sectional view of an exemplary exhaust port according to the present invention.
Figure 5:
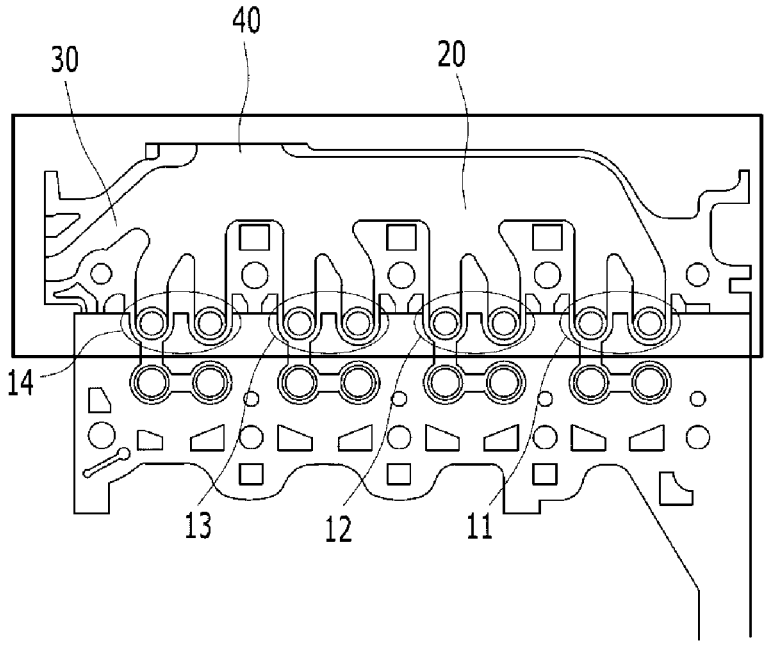
FIG. 5 is a cross-sectional view of an exhaust port structure of an exemplary cylinder head according to the present invention.

In various embodiments, as shown in FIG. 3, the connection pipe 20 may be a cuboid pipe having a predetermined width D and height C. The width D and the height C of the connection pipe 20 can be determined diversely according to the size, the structure, etc., of the exhaust port. In experiments with diesel engine cars, it was shown that the flow coefficient Cf and the T/C efficiency could be improved by forming the height C of the connection pipe 20 in the range of 23 to 25 mm and the width D of the connection pipe 20 in the range of 38 to 42 mm.

In the exhaust port structure of a cylinder head according to the present invention, the exhaust hole 40 may be formed at a position corresponding to an inlet of a turbocharger.

It is profitable for a diesel engine vehicle with a turbocharger to locate the turbocharger between the third cylinder C3 and the fourth cylinder C4 of the diesel engine shown in FIG. 2 considering the lay-out of the diesel engine and the load capacity of the vehicle. The present invention can be effectively adapted to the diesel engine by forming the exhaust hole 40 at a position corresponding to an inlet of a turbocharger considering the structure of the diesel engine with a turbocharger.

As shown in FIG. 2 to FIG. 5, the EGR line 30 can also be extended along to a side where the exhaust hole 40 is positioned by considering the above-mentioned position of the exhaust hole 40. This is because forming the EGR line 30 near the exhaust hole 40 is advantageous for exhaust gas recirculation.

The optimum structure of the exhaust port structure of the cylinder head according to the present invention can be determined by using the technique of design for six sigma (DFSS). DFSS is a business-process management methodology related to traditional six sigma, and six sigma is a business management strategy, originally developed by Motorola USA, in 1986, and today it is widely used in many sectors of industry. Six sigma seeks to improve the quality of process outputs by identifying and removing the causes of defects (errors) and minimizing variability in manufacturing and business processes. The optimum structure can be determined by selecting the radius of curvature of the bending portion (A) formed by bending down the exhaust ports 11, 12, 13, and 14 shown in FIG. 3 to FIG. 4, the length of the divided part (B) of each of the exhaust ports 11, 12, 13, and 14, and the height (C) and the width (D) of the connection pipe 20 as control parameters, selecting the deviation of the cylinders C1, C2, C3, and C4 as noise parameter, and using flow analysis.

In experiments, 35 mm is selected as the optimum radius of curvature of the bending portion (A) of the exhaust ports 11, 12, 13, and 14 in the range of 35 to 45 mm, 48 mm is selected as the optimum length (B) of the divided parts of the exhaust ports 11, 12, 13, and 14 in the range of 45 to 51 mm, 25 mm is selected as the optimum height (C) of the connection pipe 20 in the range of 23 to 25 mm, and 42 mm is selected as the optimum width (D) of the connection pipe 20 in the range of 38 to 42 mm.

The results of testing and analysis with respect to the exhaust port structure of a cylinder head applying the above-mentioned optimum radius of curvature, optimum length (B), optimum height (C), and optimum width (D) show that the flow coefficient (Cf) of the exhaust port is improved by over 5.1% and the deviation of the cylinder is improved by about 38% in comparison with the conventional art.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. An exhaust port structure of a cylinder head comprising:

a connection pipe communicating with a plurality of exhaust ports of the cylinder head, wherein each of said plurality of exhaust ports is divided into at least two ports, and wherein each of the at least two ports in each exhaust port includes an exhaust passage and the exhaust passages of the at least two ports combine to form an exhaust port outlet connected to the connection pipe; and wherein the connection pipe includes an exhaust hole disposed between two adjacent exhaust ports, the exhaust hole performing a function of an exhaust manifold;

wherein the exhaust passages of the two adjacent exhaust ports are shaped symmetrically to each other and the exhaust passages of all remaining exhaust ports of the plurality of exhaust ports are shaped identically to each other; and wherein the connection pipe has an EGR line integrally formed and connected thereto.

2. The exhaust port structure of claim 1, wherein the exhaust hole is formed at a position corresponding to an inlet of a turbocharger.

3. The exhaust port structure of claim 2, wherein the EGR line is extended from a side surface of the connection pipe where the exhaust hole is formed.

4. The exhaust port structure of claim 1, wherein each exhaust port outlet is located apart from each other by a predetermined distance.

5. The exhaust port structure of claim 1, wherein the connection pipe is a cuboid pipe having a predetermined width and height.

6. The exhaust port structure of claim 1 which is applied to a diesel engine.

* * * * *